US005855292A

United States Patent [19]

Gray et al.

[11] Patent Number: 5,855,292

[45] Date of Patent: Jan. 5, 1999

[54] FLUID STORAGE

[75] Inventors: Alan Gray, Oxon; Barry Adams, Rickmansworth, both of United Kingdom

[73] Assignee: Alcan International Limited, Montreal, Canada

[21] Appl. No.: 827,939

[22] Filed: Mar. 12, 1997

Related U.S. Application Data

[62] Division of Ser. No. 392,767, Apr. 10, 1995, Pat. No. 5,645,188.

[30] Foreign Application Priority Data

Aug. 24, 1992 [GB] United Kingdom ..... 9218003

[51] Int. Cl.[6] ..... B65D 21/02

[52] U.S. Cl. ..... 220/23.86; 220/4.21; 220/689; 220/501; 426/115; 426/131

[58] Field of Search ..... 426/112, 115, 426/124, 131; 220/566, 4.21, 4.24, 913, 501, 505, 506, 23.83, 23.86, 689

[56] References Cited

U.S. PATENT DOCUMENTS

| | | | |
|---|---|---|---|
| 2,043,694 | 6/1936 | Battles . | |
| 3,448,850 | 6/1969 | Segel et al. . | |
| 3,579,806 | 5/1971 | Heberdeau . | |
| 4,524,078 | 6/1985 | Bardsley et al. | 426/112 |
| 4,627,986 | 12/1986 | Bardsley et al. . | |
| 4,832,968 | 5/1989 | Forage et al. | 426/112 |
| 4,995,218 | 2/1991 | Byrne . | |
| 4,996,823 | 3/1991 | Byrne . | |
| 5,072,851 | 12/1991 | Wilkes . | |
| 5,340,595 | 8/1994 | Cameron-Price . | |
| 5,645,188 | 7/1997 | Gray et al. . | |

FOREIGN PATENT DOCUMENTS

| | | |
|---|---|---|
| 0 448 200 | 1/1991 | European Pat. Off. . |
| 27 687 | 5/1968 | Germany . |
| 2 211 813 | 10/1988 | United Kingdom . |
| 2 268 151 | 1/1994 | United Kingdom . |
| WO 91/00825 | 1/1991 | WIPO . |
| WO 91/13006 | 9/1991 | WIPO . |

*Primary Examiner*—Stephen J. Castellano
*Attorney, Agent, or Firm*—Watts Hoffmann Fisher & Heinke

[57] ABSTRACT

A fluid container and capsule therefor. The capsule comprises upper and lower parts, at least one of which has a dished formation and both of which have a peripheral rim, the rims being secured together so that the upper and lower parts are at least partially in register with one another to provide at least one vented chamber extending into the dished formation. The capsule includes a vent hole or like structure in at least one of the parts to communicate between the interior of the chamber and the exterior thereof. The lower part has its exterior so formed as to enable it to be held in stable engagement with a surface but so that a fluid may pass freely between those parts of the exterior of the lower part and the surface that are not in intimate engagement.

2 Claims, 4 Drawing Sheets

FLUID STORAGE

This application is a division of application Ser. No. 08/392,767, filed Apr.10, 1995, U.S. Pat. No. 5,645,188.

This invention relates to a capsule for storing and dispensing at least one fluid under pressure and also to a metal fluid container for storing and dispensing fluids, generally liquids, under pressure and which incorporates such a capsule. The invention is particularly although not exclusively concerned with containers for carbonated beverages. Such containers may be of steel or of an aluminium alloy or of a plastics/metal laminate or of plastics material.

It is well known with some beers, and particularly draught stout for it to be desirable that a creamy head should be formed on the beer when it is poured. Many such beers are now sold in cans, usually of an aluminium alloy and are pressurised by a gas. When the can is opened some formation of a head will occur but it is well known to enhance this by providing a second chamber in the form of a capsule within the can, the capsule communicating with the interior of the can via a valve or one or more small holes.

Frequently such capsules are of plastics material and are a friction fit within the can. Specifications GB 2183592 and GB/PCT 91/07326 show such arrangements. However friction fit capsules, may damage the thin protective coating customarily applied to the interior of the cans.

Other arrangements have also been proposed in which at least part of the capsule is formed as a part of the can construction either at the top or bottom thereof.

The recycling of cans of aluminium alloy is now widely practised and it has been found that when they contain capsules of plastics material problems arise in the furnaces used.

When the can is used for draught stout the second chamber constituted by the capsule is subject to various pressures in the following ways:

1) It is subject to atmospheric pressure when it is installed in the can and subsequently when the stout is first poured in.

2) When the can is sealed the pressure therein quickly rises to about 40 psi. The pressure within the capsule rises more slowly because the fluid enters the capsule more slowly. At this stage the overall pressure on the capsule acts in the sense to collapse it.

3) Pasteurisation of the can at, say, 60–80° C. causes the pressure therein to rise to say 70–80 psi. The pressure in the capsule will again lag behind that in the body of the can and the degree of lag will depend both upon the size of the hole or holes in the capsule (or the nature of its valve) and the rate of heating. Again the overall pressure on the capsule acts in the sense to collapse it. On cooling after the pasteurisation process the pressure within the can and the capsule reverts to an equilibrium position at about 40 psi.

4) When the can is opened its internal pressure drops to atmospheric substantially instantly while the pressure within the capsule, initially remains at about 40 psi. This pressure difference causes the stout plus gas within the capsule to be ejected forcefully through the hole or holes or through a valve in the capsule to generate the desired head. Thus when the can is first opened and for a short time thereafter the overall pressure on the capsule acts in the sense to inflate it.

Thus the capsule must be able to resist pressures which tend both to collapse and inflate it.

For the purpose set out above when the container is for a carbonated beverage it may be of an aluminium alloy or of steel and the capsule should in such case also be metallic, for example of an aluminium alloy. However it is also envisaged that the container including a capsule may have other uses for example in the food industry for providing two part formulations under pressure. Other uses including the storage and dispensing of adhesives are also envisaged.

Accordingly for different uses a container may be of steel, or an aluminium alloy or a plastics/metal laminate or a plastics material and fine capsule may be wholly or partly of plastics or metal.

According to one aspect of the present invention there is provided a capsule comprising upper and lower parts each having a dished formation and a peripheral rim, the rims being secured together so that the formations are at least partially in register with one another to provide at least one vented chamber, means in at least one of the parts to communicate between the interior of the chamber and the exterior thereof and the lower part having its exterior so formed as to enable it to be held in stable engagement with a surface but so that a fluid may pass freely between those parts of the exterior of the lower part and the surface that are not in intimate engagement.

The present invention also provides a fluid container having a generally cylindrical body and comprising a top a base and an annular side wall at least part of the body defining a closed primary chamber openable by manually operable means in the top the base projecting inwardly of the chamber to present an inner surface a capsule being disposed within the container and held in stable engagement against the surface.

Another aspect of the present invention is a metallic fluid container having a generally cylindrical body and comprising a top, a base and an annular side wall at least part of the body defining a closed primary chamber openable by manually operable means in the top; a capsule providing a secondary chamber within the body which is closed except for means therein to provide selective communication between the chambers the means being located at a position within the container so that when the fluid is a liquid and the container is in an upright position said means is always within the body of such liquid the capsule having walls of an aluminium alloy of a thickness less than 500 microns at least one of which is bonded to the base or the side wall.

Various embodiments of the invention will now be described by way of example with reference to the accompanying drawings in which.

Figure 1:
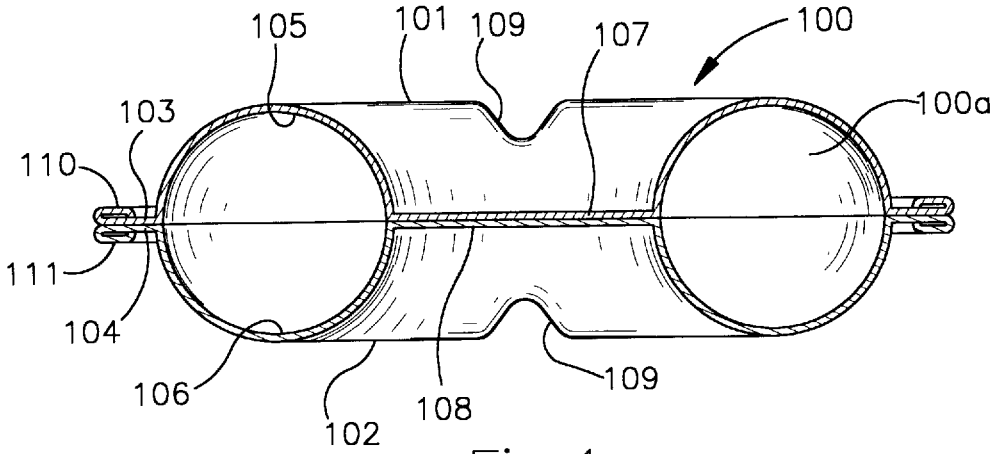
FIG. 1 is a vertical section through a capsule.
Figure 2:
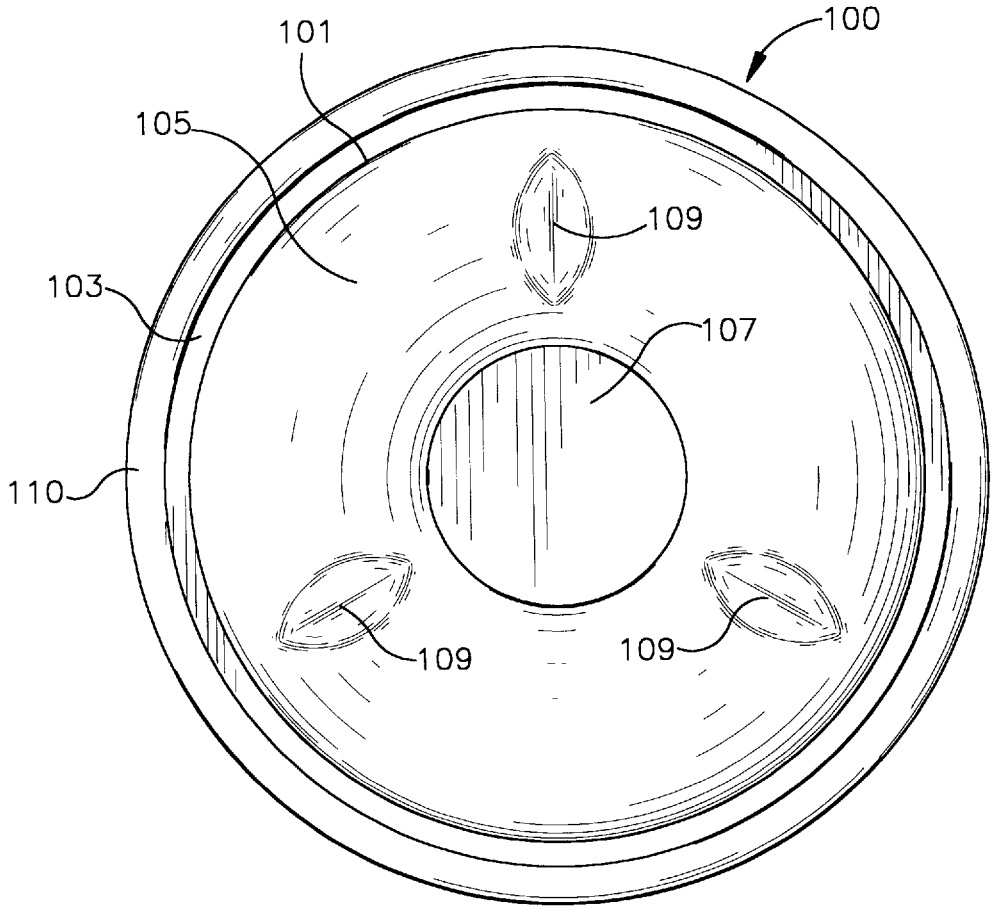
FIG. 2 is a plan view of the capsule of FIG. 1.

Referring to FIGS. 1 and 2 a capsule indicated generally at 100 has upper and lower parts 101 and 102 which are either moulded from a plastics material; press-formed of aluminium alloy foil or comprise one-plastics and one foil part. The parts 101 and 102 each have an outer flange 103, 104, an annular dished formation 105, 106 and generally flat regions 107, 108 lying within the formations 105 and 106. These regions lie in the same planes as the respective flanges 103 and 104. Thus the dished formations 105, 106 together form a toroidal chamber 100*a*. Three radial recesses 109 are formed in the dished formations 105 and 106; these are significant only in respect of one of the parts as will be described later but it is convenient both from a manufacturing and an orientation point of view to form them in both parts.

The outer edges 110, 111 of the flanges 103, 104 are curled inwardly for a purpose to be described later and the parts are secured together by adhesive (such bonding including heat sealing of plastics material and plastics coated material) bonding around their flanges and flat regions. When both parts are of aluminium foil a vent hole (not shown) will be formed between the flanges as will be described later and when one or both parts are of plastics material such vent hole may be formed at any convenient location. The vent hole may be parallel sided, tapered or stepped and its smallest diameter may be as low as 100 $\mu$m.

When one or both of the parts 101, 102 is of plastics material this is preferably of food grade polypropylene having a thickness of 0.5 to 1.5 mm and preferably about 0.8 mm. For carbonated drinks any vent hole in the plastics material should be 200 to 500 gm in diameter (at its smallest) and may be parallel sided or tapered. For other uses and for substances other than liquids and gases (for example slurries) the vent hole or holes could be of greater diameter.

If a multiplicity of holes is used it will be understood that they may each have a diameter smaller than if only one hole is provided.

The parts may be formed by conventional injection moulding techniques; they may be similar or dissimilar and they may provide, when joined, more than one sealed chamber. Also, in the case of capsules with at least one plastic part this may be fitted with a valve of known form instead of being provided with a vent hole. Such an arrangement enables the capsule to be filled with a fluid or other flowable substance in advance of incorporation in a storage container.

Although food grade polypropylene is one useful plastics material, glass reinforced plastics or carbon fibre reinforced material may also be used.

When the capsule 1 is to be incorporated in a carbonated beverage can (as shown for example in FIGS. 3, 10 and 11) which is deep drawn from an aluminium alloy it is commonplace to have an inwardly curved bottom wall 5 providing a convex inner surface. It is convenient to be able to locate the capsule of FIGS. 1 and 2 on such a surface and to this end the outer surface of 105, 106 will fit, in a stable manner on the surface. The recesses 109 ensure that fluid may flow freely between the capsule and the surface.

This free flow of fluid may be enhanced by providing, instead of the recesses 109, three outwardly projecting ribs (not shown) on the outer surface of the recess 106 of the lower part 102.

When one of the parts is of aluminium foil the capsule could be secured to the surface by ultrasonic welding but when the capsule is wholly of plastics material it is preferable to secure it ro the surface by adhesive bonding. Alternatively whatever the material of the capsule it could be held against the surface by mechanical means (not shown).

However the preferred method of securing the capsule in a container is by adhesive bonding. When the container has an epoxy lining, which is likely for carbonated beverage containers the adhesive used may be an ethylene vinyl acetate co-polymer plus resin (i.e. an EVA contact adhesive). Alternatively a hot melt adhesive (such as an EVA adhesive) may be used.

Figure 3:
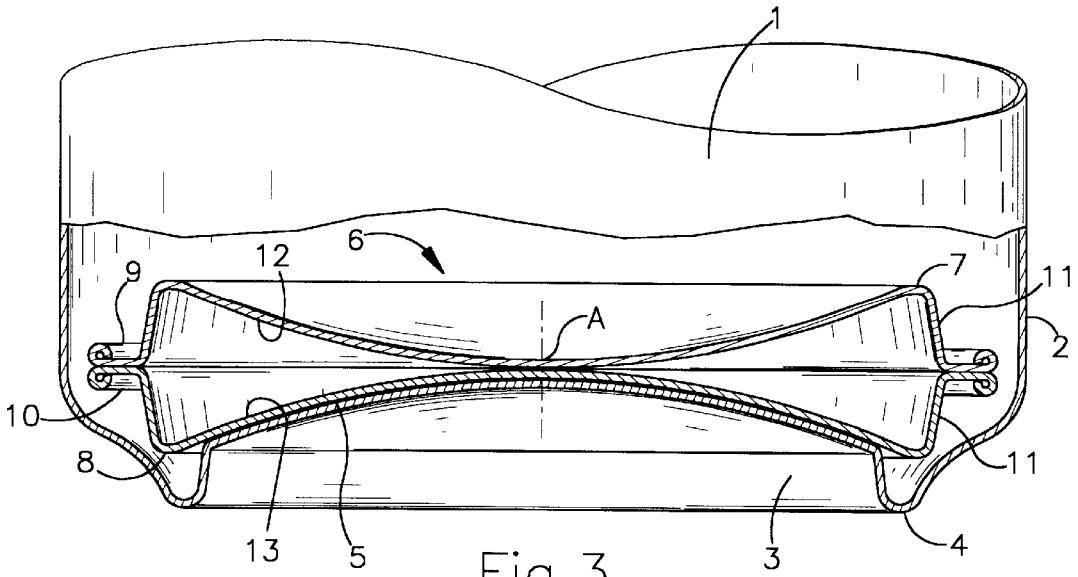
FIG. 3 shows, in section the lower end of a metal fluid container incorporating a different capsule.

Referring now to FIG. 3 as mentioned above, the lower end of a deep drawn aluminium alloy can 1 is of circular cross-sectional shape and has a side wall 2 and a shaped bottom wall 3 to provide an annular ridged part 4 and an inwardly curved bottom wall 5 having a convex inner surface. It will be understood that the upper end of the can (not shown) is provided with a top wall incorporating a ring-pull.

The ridged part 4 is inset from the periphery of the can to enable it to stack on another can and this part also enables the can to stand on a flat surface. The can thus far described is well known and is produced in large numbers as beverage containers. It will be understood that the can may be of steel.

A capsule 6 comprising a second chamber is disposed internally at the lower end of the can. This capsule is press-formed of aluminium alloy foil components and comprises (in the arrangement of FIG. 3) identical pressed-out parts 7 and 8 having rolled edges 9 and 10 which are bonded together to provide the capsule having an annular side wall 11 and inwardly dished top and bottom walls 12 and 13. It will be understood that bonding can be adhesive bonding, heat sealing or ultrasonic welding. The walls 12 and 13 are curved so that they meet at their centre —A — and, moreover their curvature is such that the bottom wall 13 sits snugly on the bottom wall 5 of the can.

The capsule 6 may be circular in cross-sectional shape; it may be oval or, for example it may be generally rectangular, with rounded corners. The parts 7 and 8 are preferably formed from an alloy selected from 1xxx, 3xxx, 5xxx or 6xxx series; preferably 3xxx, and be chosen to be compatible with the can-stock alloy used, say 3004, or a magnesium free alloy such as 3003 so that recycling of the can including the second chamber presents no problems.

The parts 7 and 8 are preferably of foil or thin sheet having a thickness of 40 to 500 $\mu$m. When the parts are of foil they may be from 50 to 300 $\mu$m with 100to 200 $\mu$m being the preferred range. The external surfaces of the parts 7 and 8 are coated with a stoving lacquer that is of sterilisable grade and has a thickness of 2 to 20 $\mu$m, preferably 3 to 5 $\mu$m. Internally, or if desired also externally, the parts 7 and 8 have a polypropylene/lacquer laminated to or coated on the foil before the parts are pressed out. This lamination may have a thickness of 20 to 75 $\mu$m and is preferably about 50 $\mu$m. The grade of polypropylene used should soften at not less than 85° C. and melt at about 160° C. Contact time should be 0.1 to 5 secs and typically 0.5 secs and it should be of food grade quality.

The capsule 6 may be sectured to the can by a single bond at the position A or by means of ultrasonic welding when the external surface of the part 7 has an appropriate laminated coating. Alternatively all or part of the mating surfaces could be provided with a patch of adhesive at the position A and localised heat applied thereto. In both cases the appropriate tool (not shown) can extend through the can before the top wall is secured thereto or tools may be applied to the inside and/or the outside of the can.

It will be understood that the interior of the capsule 6 must be vented to the interior of the can. This may be achieved in a number of different ways as will be described later.

Although the parts 7 and 8 have been described and shown as identical it will be understood that they may differ. For example the curvature of the top and bottom walls 12 and 13 may be such that they do not meet at the point A. In this case only the bottom wall is bonded to the wall 5. Alternatively the top and bottom walls 12 and 13 may meet at the point A but be of different curvature.

Figure 4:
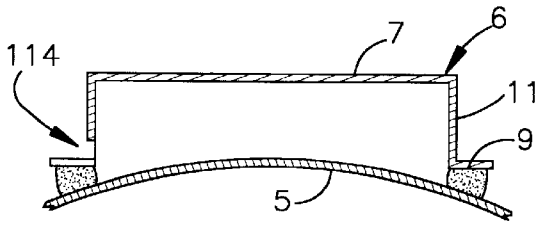
FIGS. 4 to 6 show, diagrammatically, modifications of the arrangement of FIG. 1.

FIG. 4 of the drawings shows a simpler arrangement in which the capsule 6 has only the part 7 secured directly to the bottom wall 5 around its edge 9. When, as shown, the part 7 is secured directly to bottom wall 5, a capsule is formed between the part 7 and the bottom wall 5 inwardly of the edge or rim 9. The part 7 includes means for communicating between the interior of the capsule and the exterior thereof. In the preferred embodiment shown, the means is a venting hole 114 in wall 11. Edge 9 may be curled in on itself.

Figure 5:
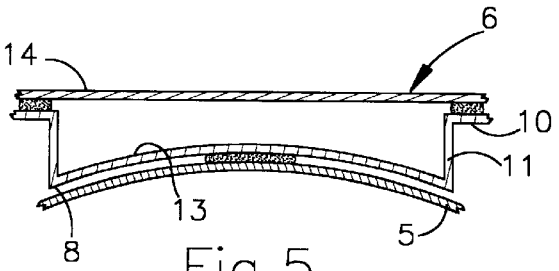

FIG. 5 shows an arrangement in which a part 8 is bonded to the bottom wall 5 and closed by a laminated foil lid 14.

Figure 6:
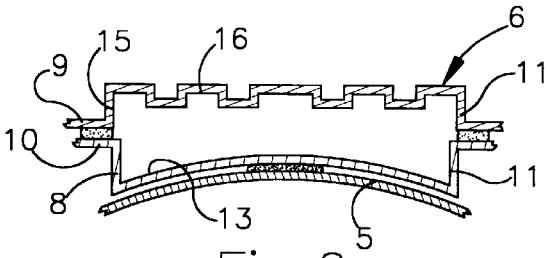

The arrangement of FIG. 6 is similar to that of FIG. 5 except that the lid 14 is replaced by a dished part 15 having an embossed surface 16.

In all the arrangements above described including FIGS. 1 and 2 it is essential that, for use in beverage cans, no aluminium should be exposed to contact by the contents of the can. Thus while the internal surfaces of the can and the appropriate surfaces,of the capsule 6 are coated as described above a problem may arise in venting the capsule 6 to the interior of the can.

One solution is to form one or more venting apertures through a wall of the capsule 6 using a laser drilling technique to ensure the flow-back of protective lacquer into the aperture(s).

Another arrangement is to locate one or more wires radially through the regions while the parts are heat sealed together. After cooling the wires are withdrawn to leave apertures which are internally coated as described above and are not exposed to raw aluminium. The wires may for example be of stainless steel or they may be coated with "non-stick" material.

Figure 7:
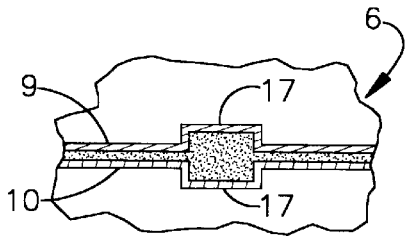
FIG. 7 shows an edge view of a flange indent.

FIG. 7 shows an arrangement in which one or more pairs of opposed indents 17 are formed in the rolled edges 9 and 10 and become filled with adhesive. This body of adhesive is then drilled to provide the necessary venting aperture(s) without exposing an aluminium surface.

Figure 8:
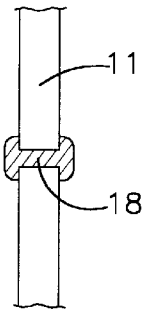
FIG. 8 shows the use of a plastic rivet.

FIG. 8 shows another construction in which plastic rivets such as 18 are inserted through a hole drilled in one or both of the parts 7 and 8. The rivet is sealed with plastics material at its ends so covering aluminium exposed by the drilling and subsequently a hole is drilled through the rivet.

Figure 9:
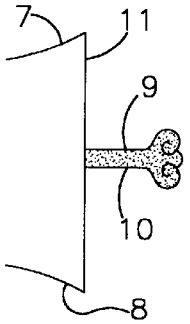
FIG. 9 shows a modified flange arrangement.

Another potential location of uncoated aluminium is the curled edges 9 and 10 of he parts 7 and 8. Conventionally the edge material would be externally curled back on itself so that a raw aluminium edge would occur only inside the rolled material and within a body of adhesive. FIG. 9 shows an alternative arrangement in which these edges are reverse curled so that during the crimping/sealing operation polypropylene material would flow into the rolls to seal the edges from the interior of the can.

Figure 10:
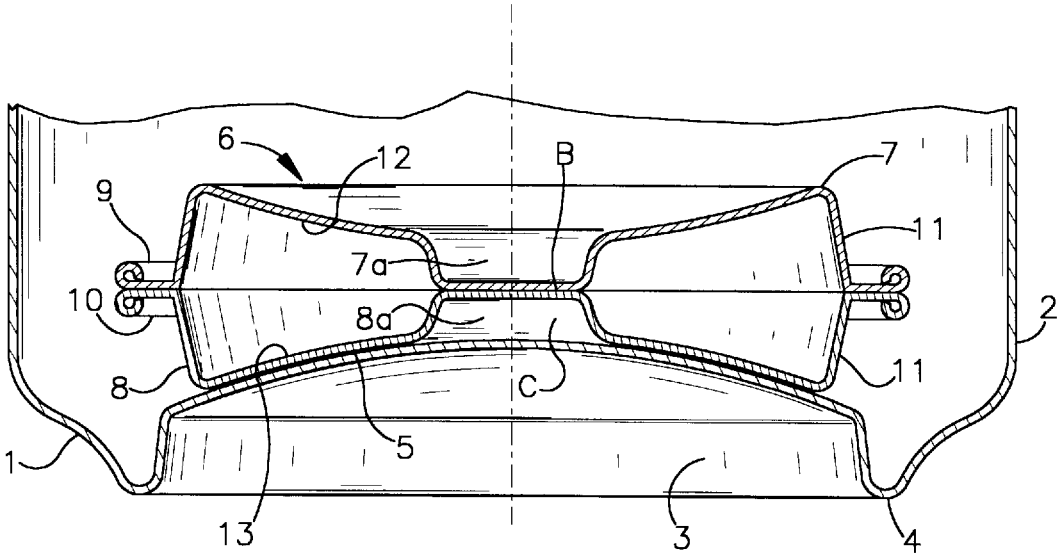
FIG. 10 shows an alternative to FIG. 3.

FIG. 10 shows a second chamber 6 of smaller diameter but greater depth than that of FIG. 3. Also in FIG. 10 the parts 7 and 8 are each formed with a central depression 7*a* and 8*a* which meet at a face B so that the second chamber is annular in the manner of FIGS. 1 and 2. Here the central depressions are also bonded together and the face B may have an aperture (not shown) to ensure that the space C communicates with the body of the can. The aperture must be appropriately coated. Alternatively the space C may communicate with the body of the can through a radial passage (not shown) between the surfaces 5 and 13.

Figure 11:
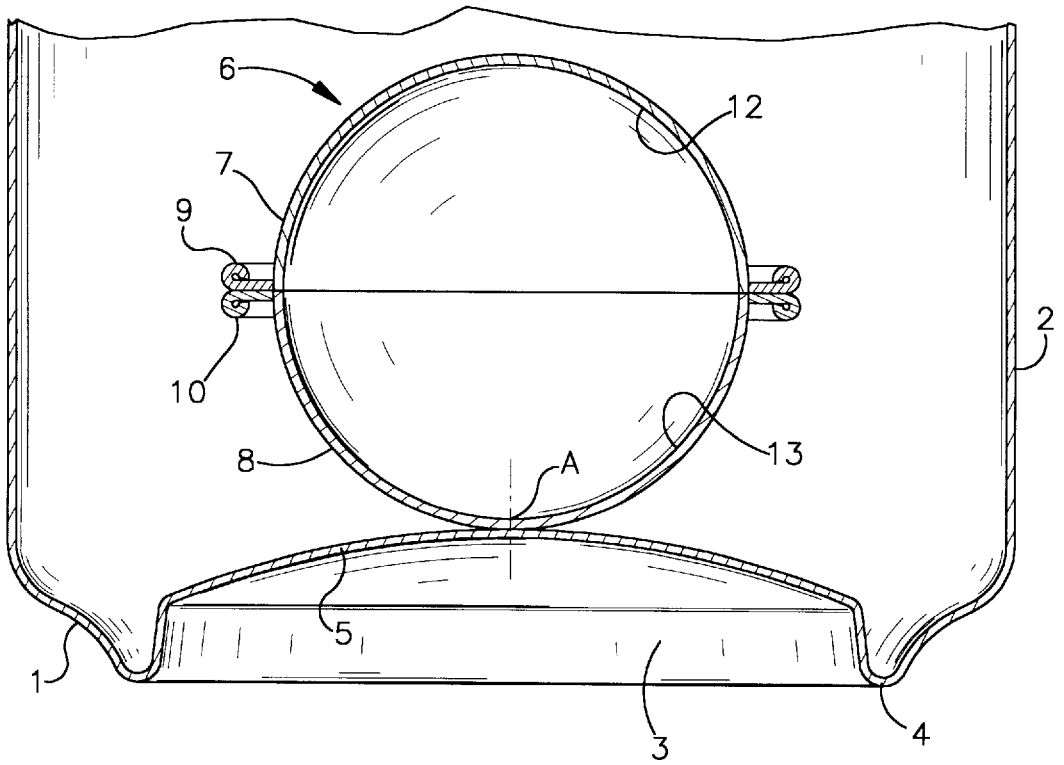
FIG. 11 shows another arrangement.

FIG. 11 is another construction in which the parts 7 and 8 are hemi-spherical.

Figure 12:
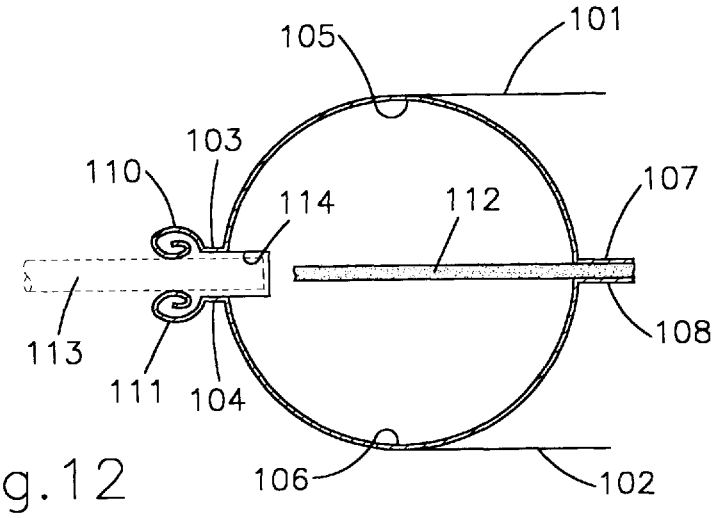
FIGS. 12 and 13 show parts of the capsule of FIG. 1 showing ways of providing a hole between the flanges and FIG. 14 is a view in the direction of the arrow 'A' in FIG. 13 and after removal of the mandrel.
Figure 13:
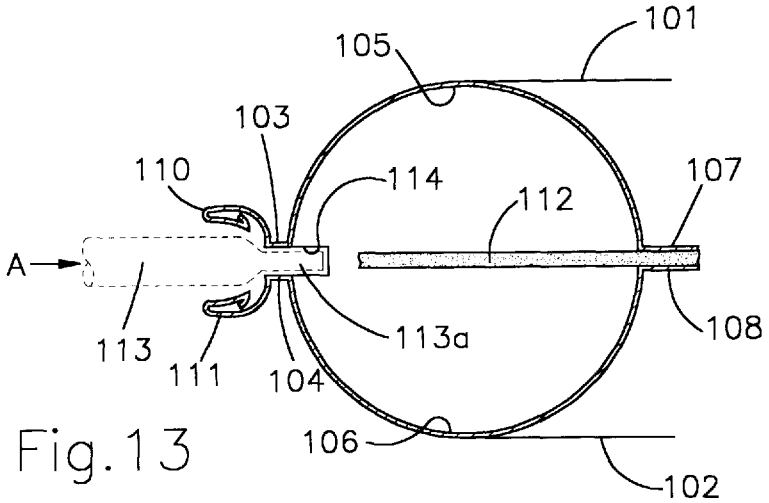
Figure 14:
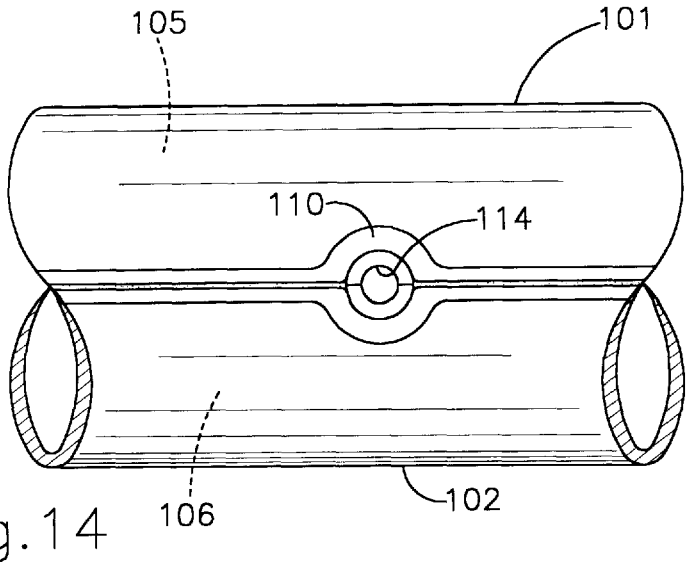

FIGS. 12 to 14 show how the capsule of FIGS. 1 and 2 may be formed with a vent aperture while the two parts 101 and 102 are being bonded together. As the parts are brought together in a suitable tool (not shown) with a layer 112 of adhesive between them (or on each part) a mandrel 113 is disposed between the rims so that the latter are distorted around the mandrel. The latter may have a non-stick finish so that when it is withdrawn a hole 114 coated with adhesive extends between the rims.

In FIG. 12 the mandrel is of constant diameter. In FIG. 13 it has a reduced diameter inner end 113*a* so that the hole 114 is of stepped formation. FIG. 14 is a view in the direction of the arrow A of FIG. 13 after withdrawal of the mandrel.

Although it has been assumed in FIGS. 7, 8, 9 and 12 to 14 that the venting of the capsule by providing a hole between the rims should be in a radial direction it will be understood that this hole may extend at an acute angle to a radius so long as it remains in the plane of the rims. It is desirable that in the case of a single hole the ratio between the length of the hole and the smallest diameter should be between 3:1 and 8:1 preferably about 5:1. When multiple holes are used the diameters and ratios may be altered.

Instead of using a mandrel as described in connection with FIGS. 12 to 14 a wire (preferably tubular to exhaust gases) may be disposed between the rims wholly within the thickness of the adhesive 112. When this wire is withdrawn (to be reused) the appropriate vent hole remains.

Of all the arrangements above described those of FIGS. 1 and 2, FIG. 3 or FIG. 10 or FIG. 11 are preferred when the capsule is to be subject to comparatively high pressure differentials for example during the pasteurisation of cans containing stout and when such cans are opened. However the arrangements of FIGS. 4, 5 and 6 may also be used for this purpose by locally increasing their wall thickness or, as in FIG. 6, by forming the embossed surface 16.

In general when the capsule is of press-formed aluminium it may advantageously incorporate one or more of the following strengthening features:

1) Convex or concave curvature to one or both of its top and bottom walls 12 and 13
2) Peripheral flanges such as 9 and 10 to resist hoop stress
3) An embossed (i.e.) ribbed face such as 16 (FIG. 6)
4) Stable location of the capsule against the can base.
5) Thicker materials in some parts of the second chamber. This is particularly the case in FIGS. 4 and 5.

The arrangements of FIGS. 1, 3, 10 and 11 can be produced having a weight of about 3 gms (as opposed to about 5 gms to 35 gms for a plastics capsule). This reduces the thermal mass of the capsule. A low thermal mass coupled with the high conductivity of the thin material of the capsule assists the pasteurisation process for cans of stout.

Although as described above the container 1 has an inwardly projecting base providing a lower inner surface it will be understood that a container, for example of different material, may have a flat or a concave inner surface.

In this specification the term "fluid" is to be understood as meaning not only liquids and gases but also other substances such as pastes, creams and slurries that are flowable at least at selected temperatures.

We claim:

1. A fluid container having a generally cylindrical body and comprising a top, a base and an annular side wall, at least part of the body defining a closed primary chamber openable by manually operable means in the top, the base projecting inwardly of the primary chamber to present an inner surface, a capsule comprising upper and lower parts, at least one of which has a dished formation and both of which have a peripheral rim, the rims being secured together so that the upper and lower parts being distinct from said top, base and side wall and at least partially in register with one another to provide at least one vented secondary chamber extending into the dished formation, means in at least one of the parts to communicate between the interior of the secondary chamber and the exterior thereof, wherein the upper and lower parts of the capsule are laminated or coated with a protective material.

2. The fluid container of claim 1, wherein at least a portion of the capsule is made of aluminum.

* * * * *